US008832973B2

(12) United States Patent
Gallacci

(10) Patent No.: US 8,832,973 B2
(45) Date of Patent: Sep. 16, 2014

(54) SCRAPER BLADE ON WHEELS WITH A PULL HANDLE FOR LEVELING DIRT

(76) Inventor: Jefry Stuart Gallacci, Mattawa, WA (US)

( * ) Notice: Subject to any disclaimer, the term of this patent is extended or adjusted under 35 U.S.C. 154(b) by 194 days.

(21) Appl. No.: 13/200,725

(22) Filed: Sep. 28, 2011

(65) Prior Publication Data

US 2012/0080204 A1 Apr. 5, 2012

Related U.S. Application Data

(60) Provisional application No. 61/388,745, filed on Oct. 1, 2010.

(51) Int. Cl.
*E01H 5/02* (2006.01)
*E02F 3/02* (2006.01)

(52) U.S. Cl.
CPC ..... *E02F 3/02* (2013.01)
USPC ..... 37/265; 37/270; 37/285

(58) Field of Classification Search
USPC ..... 37/264, 265, 270, 284, 285; 294/54.5; D8/10
See application file for complete search history.

(56) References Cited

U.S. PATENT DOCUMENTS

| | | | | | |
|---|---|---|---|---|---|
| 1,572,824 | A * | 2/1926 | Tatge | 37/283 |
| 2,508,612 | A * | 5/1950 | Kimbler | 37/284 |
| 2,715,786 | A * | 8/1955 | Dorko | 37/283 |
| 2,811,792 | A * | 11/1957 | Cork, Jr. | 37/284 |
| D190,820 | S * | 7/1961 | O—Connor | D15/11 |
| 3,007,263 | A * | 11/1961 | Lair | 37/241 |
| 3,043,033 | A * | 7/1962 | Ingram et al. | 37/434 |
| 3,475,838 | A * | 11/1969 | Hagen et al. | 37/265 |
| 4,048,735 | A * | 9/1977 | Brunty | 37/434 |
| D305,603 | S * | 1/1990 | Nelson et al. | D15/11 |
| 4,910,893 | A * | 3/1990 | Asay | 37/281 |
| D314,318 | S * | 2/1991 | Uimonen | D8/10 |
| 5,465,510 | A * | 11/1995 | Goodnough et al. | 37/285 |
| D378,890 | S * | 4/1997 | Furno | D3/10 |
| 5,669,163 | A * | 9/1997 | Winter | 37/284 |
| 6,334,640 | B1 * | 1/2002 | Werner et al. | 294/54.5 |
| 6,457,757 | B2 * | 10/2002 | Hendrick | 294/54.5 |
| D656,162 | S * | 3/2012 | Wiik | D15/11 |
| 2005/0160632 | A1 * | 7/2005 | Williams | 37/265 |

FOREIGN PATENT DOCUMENTS

| | | | | |
|---|---|---|---|---|
| DE | 3717334 | A1 * | 12/1988 | E01H 5/02 |

* cited by examiner

*Primary Examiner* — Jamie L McGowan

(57) ABSTRACT

A devise which is a blade which is connected to two wheels, one at either end of the blade. A handle is also connected to the blade which is a person uses to pull the device across the surface of material to be moved. The device can be used to move material such as dirt or sand in a manner which allows easy leveling of the material.

13 Claims, 3 Drawing Sheets

SCRAPER BLADE ON WHEELS WITH A PULL HANDLE FOR LEVELING DIRT

CROSS-REFERENCE TO RELATED APPLICATION

This application claims the benefit of U.S. Provisional Application No. 61/388,745 filed Oct. 1, 2010, the entire disclosure of which is incorporated herein by reference in its entirety.

BRIEF DESCRIPTION OF DRAWINGS

Attached to this application are 3 drawings; in FIG. 1, item #5 is also labeled as Arm, with a directional arrow pointing to the component. In the subsequent text, components of the device will be referenced to by their numeric identifier and the component name.

FIG. 1 is a top view of the device showing all the components of the device. The view shows the device as it would appear from above as the device rests on a level surface. This view shows the relative position of the Arm, Blade and Support Brackets the Axle and Wheels.

FIG. 2 is the view from the right side of the device as the device would rest on a level surface. FIG. 2 shows fewer of the components of the device due to the restrictive nature of the view. This view shows the relative position of the angled Arm and the attachment of the Arm to the Blade.

FIG. 3 is a view of the device from the front and to the right of the device, at a quartering angle, as the device would rest on a level surface. This view shows the attachment of the blade supports to the blade, and the relative position to the wheels. For use in the subsequent text, the device in it's entirety is referenced in FIG. 3, which shows a more comprehensive view of the device and it's components, and is referenced as "Scraper".

PARTS OR COMPONENTS OF THE INVENTION

Please refer to the drawings for a key to the reference numbers, angles and dimensions.

Figure 3:
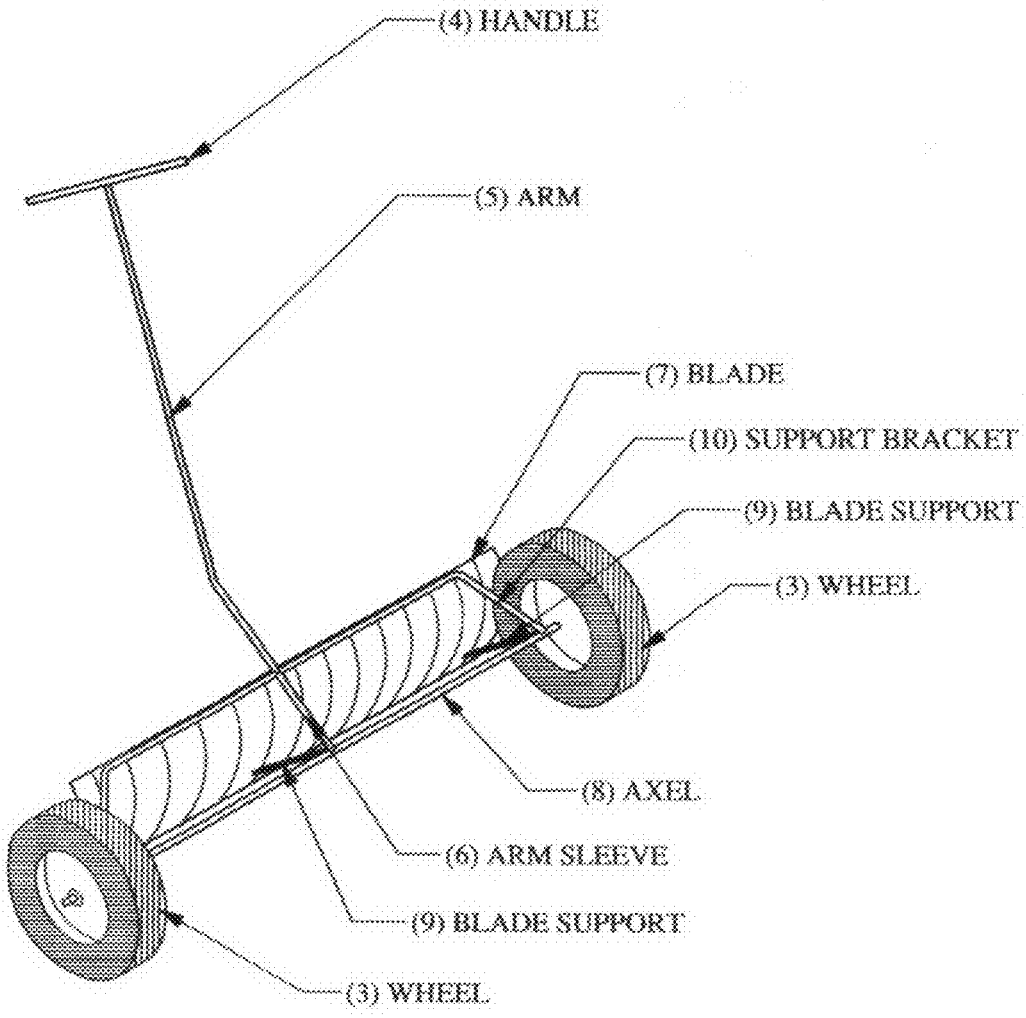

| Reference Number | Name of Part |
|---|---|
| FIG. 3 | Scraper |
| 3 | Wheels |
| 4 | Handle |
| 5 | Arm |
| 6 | Arm Sleeve |
| 7 | Blade |
| 8 | Axle |
| 9 | Blade supports |
| 10 | Support bracket |
| 11 | Pin |

The Scraper as referenced in FIG. 3 is a device configured to allow a person to pull with both hands, and level the loose surface it is being pulled across. The Scraper as referenced in FIG. 3 is pulled across the surface on the wheels 3.

The wheels 3 are round and of a diameter of ½ a foot to 2 feet, preferably closer to 1 foot. The width of the wheels 2 is between 1 inch and 6 inches, preferably around 2 inches. The wheels 3 are designed to allow the Scraper as referenced in FIG. 3 to be rolled across the surface upon which it rests, so any size which would accommodate such a function would be preferable. There are 2 wheels 3, set apart from one another by about 2 to 4 feet, preferably about 3 feet or more. The wheels 3 are of a nature to have a hole in the center for a shaft to perform the function of a point to roll around. The wheels 3 may comprise any hard or soft supportive material known in the art, including but not limited to metal, plastic and rubber, or any combination thereof.

The handle 4 is a piece of the Scraper as referenced in FIG. 3 that is designed for a person to grab with both hands and pull. The handle 4 may comprise any hard or soft supportive material known in the art, including but not limited to metal, plastic and rubber, or any combination thereof. It is preferably shaped as a long, thin cylinder having a circular cross section, but could take on any other shape such as a rod having an oval, rectangular, hexagonal or square cross section. It is configured to be something grabbed by a persons hands, and therefore is about ½ inch to 2 inches in diameter, preferably about ¾ inches in diameter.

The arm 5 is attached to the handle 4 and connects the handle 4 to the rest of the Scraper as referenced in FIG. 3. The arm 5 is configured to hold the handle 4 above the ground about 2 feet to 4 feet, preferably about 3 feet for ease of use by a person. The arm 5 is configured at angle A, which is preferably 35 degrees from a relative horizontal line, but may be as much as 45 degrees, and as little as 10 degrees from the same horizontal plane. The arm 5 may be comprised of any hard or soft supportive material known in the art, including but not limited to metal, plastic and rubber, or any combination thereof. It is preferably shaped as a long, thin cylinder having a circular cross section, but could take on any other shape such as a rod having an oval, rectangular, hexagonal or square cross section. The arm 5 may be set at an angle of between 10 degrees or 50 degrees relative to a horizontal plane, to accommodate the handle 4 being at a point above the horizontal surface upon which the Scraper as referenced in FIG. 3 rests as to be convenient for a person to grab. The arm 5 has a hole at the opposite end of the handle 4, located preferably about 3 inches from the end of arm 5, but may be anywhere from 2 to 6 inches from the end. The hole in arm 5 is preferably ⅜ inch in diameter, but may vary from ¼ inch to ½ inch. The hole is made perpendicular to the arm 5, such that a shaft of appropriate size, placed through the hole at the end of arm 5, would be perpendicular to arm 5.

The arm 5 is attached to the rest of the Scraper as referenced in FIG. 3 in the arm sleeve 6. The arm sleeve 6 is a tube, preferably shaped as a long, thin cylinder having a circular cross section, but could take on any other shape such as a tube having an oval, rectangular, hexagonal or square cross section. The arm sleeve 6 is configured to the same shape as the arm 5, and the arm 5 is configured to slide into the arm sleeve 6. The arm 5 may be comprised of any hard or soft supportive material known in the art, including but not limited to metal, plastic and rubber, or any combination thereof. The arm sleeve 6 is preferably about 8 inches long, but may vary from 4 inches long to 12 inches long. The arm sleeve 6 has a hole at one end, located preferably about 3 inches from the end of arm 5, but may be anywhere from 2 to 6 inches from the end. The hole in arm 5 is preferably ⅜ inch in diameter, but may vary from ¼ inch to ½ inch. The hole is made perpendicular to the arm sleeve 6, such that a shaft of appropriate size, placed through the hole at the end of arm sleeve 6, would be perpendicular to arm sleeve 6.

The blade 7 is comprised of any hard or soft supportive material known in the art, including but not limited to metal, plastic and rubber, or any combination thereof. It is preferably about 4 feet wide, 8 inches in height, and ⅛ inch thickness, although the width may vary from 2 feet to 6 feet, the height may vary from 3 inches to 14 inches and the thickness may vary from 1/16 inch to ½ inch. The blade 7 is preferably configured as a long rectangle, but could take on any other shape such as an oval or square. The blade 7 is preferably configured with a curve which runs in a line longitudinally down the blade 7. The longitudinal curve defined by dimension C is preferably 1 inch, but may be ⅛ inch to 2 inches. The blade 7 is configured to rest along a horizontal plane, and to rest upon the surface upon which the Scraper as referenced in FIG. 3 sits, with the long edge against the surface upon which the Scraper as referenced in FIG. 3 rests. The blade 7 is preferably configured to sit at angle B, which is preferably about 30 degrees from a vertical plane. Angle B may range from 0 degrees to 45 degrees either direction from a relative vertical plane.

The axle 8 is comprised of any hard or soft supportive material known in the art, including but not limited to metal, plastic and rubber, or any combination thereof. The axle 8 is preferably a tube, preferably shaped as a long, thin cylinder having a circular cross section, but could take on any other shape such as a tube having an oval, rectangular, hexagonal or square cross section. The axle 8 may even be comprised as a solid shaft with the same variations in cross section as the tube. The axle 8 is preferably ½ inch in diameter, but may vary from ¼ inch to 2 inches, or a combination thereof along the length of axle 8. The axle 8 is preferably over 3 feet in length, but may vary between 2 feet and 6 feet.

The blade support 9 is comprised of any hard or soft supportive material known in the art, including but not limited to metal, plastic and rubber, or any combination thereof. It is preferably shaped as a thin, narrow solid rectangle preferably about 1 inch wide and about ¼ inch thick, but may vary from ¼ inch wide to 3 inches wide, and from ⅛ inch thick to 1 inch thick. The blade support 9 preferably has a thin rectangular cross section, but could take on any other shape such as an oval, round, hexagonal or square cross section.

Figure 1:
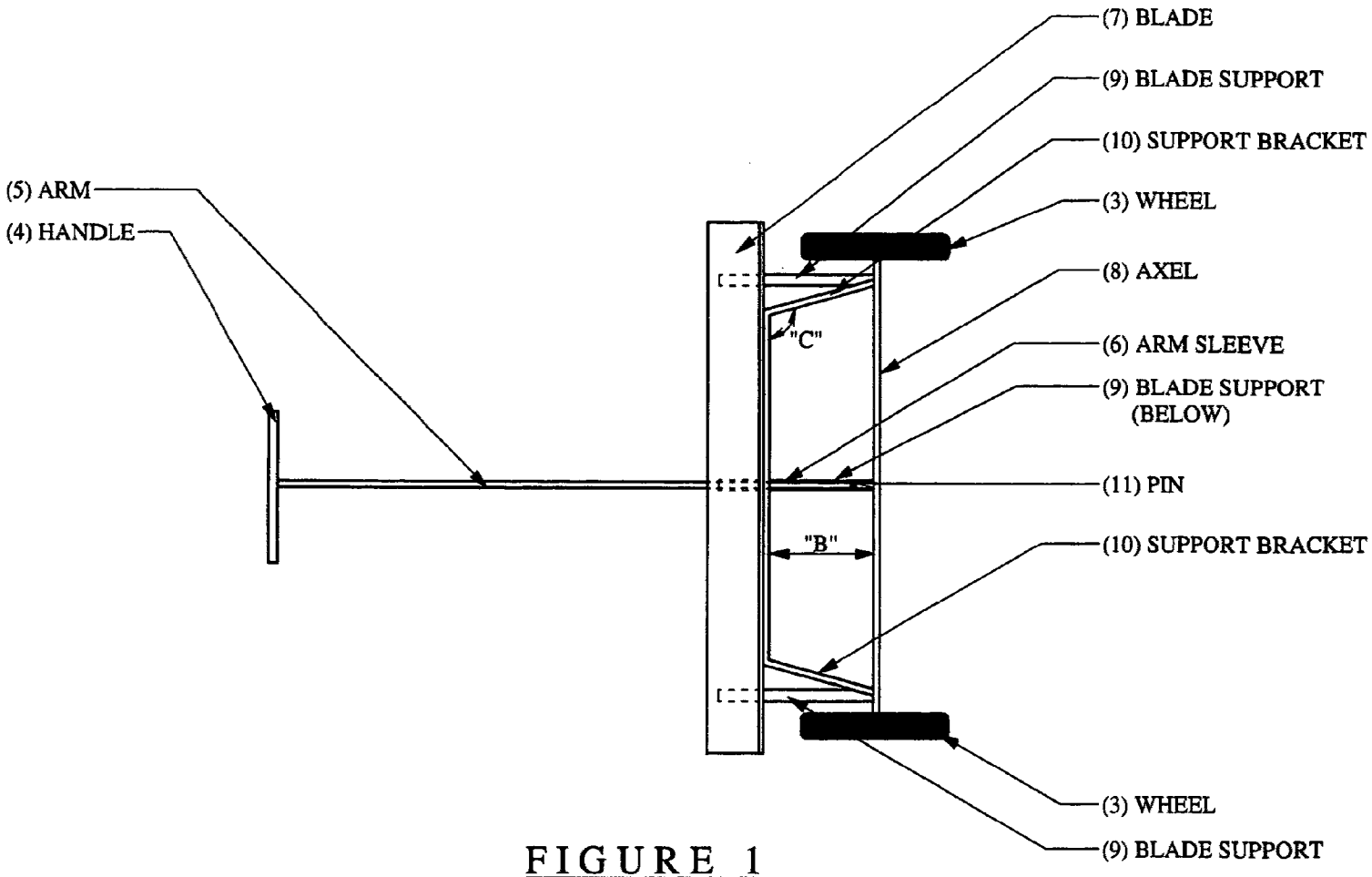
FIG. 1, FIG. 2 and FIG. 3. Each drawing is labeled as FIG. 1, 2 or 3 at the bottom of the drawing, and components of the device are labeled numerically and by what each component is, with a corresponding arrow showing the exact component, ie.

The support bracket 10 is comprised of any hard or soft supportive material known in the art, including but not limited to metal, plastic and rubber, or any combination thereof. The support bracket 10 is preferably a tube, preferably shaped as a long, thin cylinder having a circular cross section, but could take on any other shape such as a tube having an oval, rectangular, hexagonal or square cross section. The support bracket 10 may even be comprised as a solid shaft with the same variations in cross section as the tube. The support bracket 10 is preferably ¼ inch in diameter, but may vary from ¼ inch to 2 inches, or a combination thereof along the length of support bracket 10. The support bracket 10 is shaped in a manner like a bow with a flat side. This bow-shape is visible in FIG. 1. The curves which make the bow shape of support bracket 10 are identified in FIG. 1 as angle C. The angle C is preferably about 115 degrees, but may vary between 90 degrees and 135 degrees.

The pin 11 is a ¼ inch solid shaft, comprised of any hard or soft supportive material known in the art, including but not limited to metal, plastic and rubber, or any combination thereof. It is preferably shaped as a short, thin cylinder having a circular cross section, but could take on the cross section of a square, hexagon, oval or a combination thereof.

Relationship Between the Components (Ie, how they are Connected)

The handle 4 is connected to the arm 5, preferably in a perpendicular orientation to the arm 5. The attachment point of the handle 4 and the arm 5 being located preferably at the mid-point of the handle 4. Any connections described in this application may include any known connectors, including screws, bolts, adhesives, metal welds, clamps, clips rivets, etc. This orientation is apparent in FIG. 1.

The wheel 3, of which there are 2, attach to either end of the axle 8. The attachment is in such a manner that the end of axle 8, on each end, protrudes through the center hole of the wheel 3 preferably approximately ½ inch. When attached to the axle 8, a wheel 3 is located on either end of axle 8.

Each end of the support bracket 10 is attached to axle 8 on each end of axle 8 near the wheel 3. The attachment point for support bracket 10 is preferably about 3 inches inside of wheel 3 on each end of the axle 8, but may vary between 1 inch and 6 inches.

The arm sleeve 6 attaches to the support bracket 10 at the middle point of support bracket 10 and axle 8. The arm sleeve 6 is joined to both the support bracket 10 and the axle 8, with a perpendicular orientation to axle 8.

The arm 5 is attached to the arm sleeve 6 by sliding the arm 5 into the arm sleeve 6 at the end of arm sleeve 6 closest to the support bracket 10, until the arm 5 is visible at the end of arm sleeve 6 closest to the axle 8.

The pin 11 is inserted in a hole in arm sleeve 6 after the arm 5 is inserted in the arm sleeve 6. The pin 11 will pass through the hole in arm 5 and arm sleeve 6. The pin 11 will keep the arm 5 affixed to arm sleeve 6.

Figure 2:
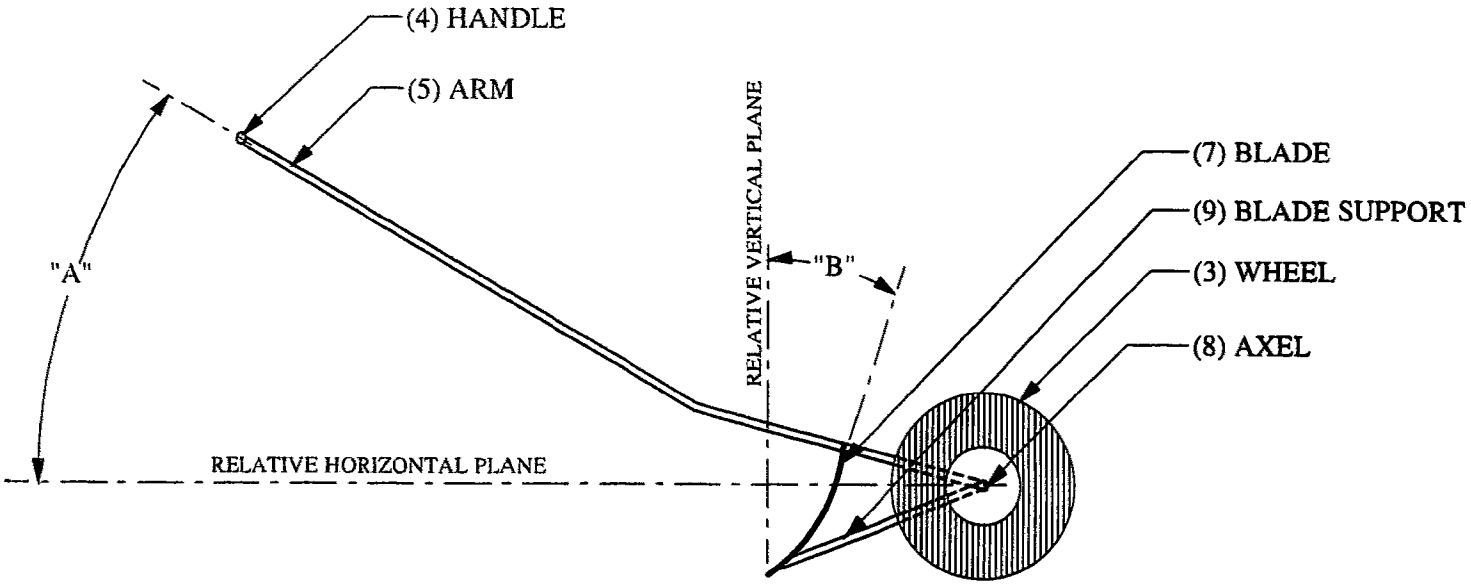

The blade 7 is connected to the support bracket 10 along the top of the blade 7. The blade 7 is centered preferably such that the mid-point of blade 7 is aligned with the mid-point of the support bracket 10, and aligned with arm sleeve 5, also located at the mid-point of support bracket 10. The blade is preferably attached at an angle represented in FIG. 2, Angle B. The blade 7 is configured to rest along a horizontal plane, and to rest upon the surface upon which the Scraper as referenced in FIG. 3 sits, with the bottom long edge against the surface upon which the Scraper as referenced in FIG. 3 rests. The blade 7 is preferably configured to sit at angle B in FIG. 2, which is preferably about 30 degrees from a vertical plane. Angle B may range from 0 degrees to 45 degrees either direction from a relative vertical plane. The top long edge of the blade 7 is attached to the bow portion of support bracket 10.

The blade supports 9 are attached from the axle 8 to the bottom of blade 7. There may be as few as 2 or as many as 3 blade supports 9. Preferably there are 3 blade supports 9, the first blade supports 9 is attached to the mid-point of axle 8, and to a point on the back of the blade 7 near the bottom of blade 7. The other 2 blade supports 9 are attached to the axle 8 near each end, preferably about 3 inches from the end of axle 8, but may be attached as little as 1 inch or as much as 1 foot from the end of axle 8. Each of the other 2 blade supports 9 are attached in like manner to the back of the blade 7 near the bottom.

How the Invention Works:

The Scraper as referenced in FIG. 3 works with human power to smooth a surface. The person operating the Scraper as referenced in FIG. 3 pulls the Scraper as referenced in FIG. 3 across the surface. The height of the handle 4 above the ground determines the depth at which the blade 7 will cut into the soft surface. Because the handle 4 and arm 5 act as a lever, pivoting on the axle 8, raising and lowering the handle 4 lifts and lowers the blade 7 to adjust how deep or shallow the blade 7 cuts through the surface. The wheels 3 carry all the weight of the Scraper as referenced in FIG. 3 when the handle 4 is lifted high, and the blade 7 carries all the weight of the Scraper as referenced in FIG. 3 when the handle 4 is lowered. The corresponding lifting and lowering of the handle 4, while the person pulls the Scraper as referenced in FIG. 3, provides the smoothing action the Scraper as referenced in FIG. 3 is invented for, allowing the person to move more material into a shallow area, and less from a high area.

Necessary and Optional Elements of the Invention:

The handle 4, wheels 3, arm 5, blade 7, support bracket 10 and blade supports 9 are necessary elements of this invention. The arm sleeve 6 and pin 11 provide a convenience of removing the arm 5 from the blade 7, making the Scraper as referenced in FIG. 3 easier to store and transport.

This invention may include additional beneficial features as handle grips, or a grip-type surface attached to the handle 4 where a person's hands would grab the handle 4. This could provide a comfortable gripping surface. An additional feature would be weights to attach to arm 5 to assist the person wishing to dig more aggressively into the surface with the Scraper as referenced in FIG. 3. Such weights might be manufactured in the shape of a doughnut with a portion missing, so they could slide onto the arm 5 near the arm sleeve 6, to provide more downward force for the blade 7 into the surface.

How to Use the Invention:

The invention provides a means for a person to smooth loose sand, gravel, dirt, etc. over a relatively large area quickly and with little effort. The handle 4 provides a means for a person to grab the Scraper as referenced in FIG. 3, while facing the Scraper as referenced in FIG. 3. With both hands grasping the handle 4, with one hand on either side of the arm 5, the person will drag the Scraper as referenced in FIG. 3 across the surface to be smoothed by walking backwards, pulling the Scraper as referenced in FIG. 3 along with the person. The blade 7 can be controlled to dig more or less into the surface by the person by raising or lowering the handle 4 above the ground while pulling the Scraper as referenced in FIG. 3. When a person wishes to relocate the scraper to a new location, the handle 4 may be lifted higher above the ground upon which the Scraper as referenced in FIG. 3 rests, to a point where the blade 7 is no longer touching the surface, and the person then pushes the Scraper as referenced in FIG. 3 so it can roll on the wheels 3.

A System that Could Benefit from the Invention:

The Scraper as referenced in FIG. 3 could be used in part of a landscaping system where raking would commonly occur to smooth dirt in preparation for lawn or gardens. The scraper would eliminate the need for rakes, and would allow more work to be done with less effort.

The Scraper as referenced in FIG. 3 would be a useful feature of preparing forms for pouring concrete. If the forms are too large for convenient raking to smooth the underlayment conveniently, and too small for a tractor, the Scraper as referenced in FIG. 3 would provide an alternative to excess labor for raking.

What is claimed is:

1. A scraper blade on wheels comprising: a blade coupled with a pair of wheels, the wheels attached to one another with an axle, the blade attached to a support bracket which is attached to the axle; a handle attached to an extended arm and the arm arranged perpendicular to the blade, said arm immovably attached to the support bracket of the blade and in such a manner as to establish the blade at an angle relative to the resting surface and extending in front of the blade as it is being pulled, held in place by blade supports, the entire apparatus configured such that the blade rests on a level surface and the wheels rest on the same surface and the entire apparatus rests in entirety on the surface with the arm and handle assembly extending into the air at an angle and the blade is positioned in between the wheels and the handle.

2. The scraper blade on wheels of claim 1, wherein the blade is concave toward the direction of operation.

3. The scraper blade on wheels of claim 1, wherein the arm and handle are attached at an angle and are of a length to arrive at a height for gripping the handle.

4. The scraper blade on wheels of claim 3, wherein the arm is attached to the support bracket and axle in a manner as to allow for removal.

5. The scraper blade on wheels of claim 3, wherein the arm is angled at a point approximating a mid-point, raising the end higher toward an operator than if the arm were straight.

6. The scraper blade on wheels of claim 1, wherein the blade supports connect the axle to the blade, near the bottom of the blade which is near to the surface upon which the apparatus rests.

7. The scraper blade on wheels of claim 2, wherein the blade is of a particular length.

8. The scraper blade on wheels of claim 2, wherein the blade is curved along its longitudinal axis, maintaining a straight edge against the surface upon which it rests.

9. The scraper blade on wheels of claim 1, wherein the blade is attached to the blade supports and support bracket at an obtuse angle relative to the surface upon which it rests.

10. The scraper blade on wheels of claim 9, wherein the blade is configured to the apparatus at an obtuse angle relative to the surface upon which it rests, and in its direction of travel.

11. The scraper blade on wheels of claim 1, wherein the blade attached to the axle and support bracket is configured such as to pivot on its edge which rests on the surface.

12. The scraper blade on wheels of claim 4, wherein the arm fits into an arm sleeve, a slightly larger piece of tube material wherein the arm may fit with small tolerance, and remain in-place with a piece of rigid material running through congruent holes drilled in the arm and the sleeve.

13. An apparatus for leveling sand, dirt or other materials comprising: a concave blade attached to a pair of wheels, the wheels attached to one another with an axle, the blade attached to a support bracket which is attached to the axle; a handle attached to an extended arm and the arm arranged perpendicular to the blade, the arm immovably attached to the support bracket of the blade in such a manner that the blade is in between the wheels and the handle and the handle extends in front of the blade as it is being pulled and a user lifting the handle in an upward direction lifts the blade in an upward direction and a user pulling the apparatus by the handle scrapes the bottom edge of the blade along the ground with the concave blade facing the user.

* * * * *